US005305828A

United States Patent [19]

White et al.

[11] Patent Number: 5,305,828

[45] Date of Patent: Apr. 26, 1994

[54] COMBINATION PACKER/SAFETY VALVE ASSEMBLY FOR GAS STORAGE WELLS

[75] Inventors: Pat M. White, Carrollton; Robert W. Crow, Irving, both of Tex.

[73] Assignee: Halliburton Company, Houston, Tex.

[21] Appl. No.: 52,899

[22] Filed: Apr. 26, 1993

[51] Int. Cl.[5] ..... E21B 33/12

[52] U.S. Cl. ..... 166/120; 166/151; 166/184

[58] Field of Search ..... 166/120, 126, 128, 133, 166/151, 188, 321, 324, 325, 184

[56] References Cited

U.S. PATENT DOCUMENTS

| | | | |
|---|---|---|---|
| 2,909,227 | 10/1959 | Bostock | 166/184 X |
| 3,580,332 | 5/1971 | Dean et al. | 166/151 X |
| 4,453,599 | 6/1984 | Fredd | 166/184 X |
| 5,117,906 | 6/1992 | Giusti, Jr. et al. | 166/120 |
| 5,141,053 | 8/1992 | Restarick et al. | 166/120 |

*Primary Examiner*—William P. Neuder
*Attorney, Agent, or Firm*—Tracy W. Druce; J. Richard Konneker

[57] ABSTRACT

A combination packer/safety valve assembly is connectable to the bottom end of a tubing string and lowerable therewith into the casing string portion of a gas storage well to control the upward flow through the casing string of pressurized gas stored in a subterranean cavern below the casing string. In response to the delivery through the tubing string to the interior of the assembly of control fluid at a first predetermined pressure a normally closed, axially extending interior passage of the assembly is opened to permit upward flow therethrough of pressurized gas for delivery to the well surface through the casing string. An increase of the control fluid pressure to a higher, predetermined second magnitude radially extends an anchor slip and packer structure externally carried by the assembly body into an anchored, sealing engagement with the interior surface of the casing string, and a locking structure automatically functions to hold the anchor slip and packer structure in this radially extended orientation. A subsequent increase of the control fluid pressure to a still higher, predetermined third magnitude causes the anchor slip and packer structure to be driven back to a radially retracted position, thereby releasing the assembly for upward retrieval movement with the tubing string through the casing string.

20 Claims, 3 Drawing Sheets

COMBINATION PACKER/SAFETY VALVE ASSEMBLY FOR GAS STORAGE WELLS

BACKGROUND OF THE INVENTION

The present invention generally relates to flow control apparatus for subterranean wells and, in a preferred embodiment thereof, more particularly relates to packer and safety valve apparatus used to shut-in a subterranean gas storage well.

Previously retrieved natural gas is often stored in underground cavern structures, such as salt caverns or abandoned mine shafts, for later use. To effect such storage a gas storage well is constructed by extending a casing string from a surface wellhead structure downwardly through the earth to the subterranean cavern, and then pumping the gas downwardly through the casing string into the cavern. To keep the pressurized gas delivered to the cavern from simply forcing its way up the casing string when the pumping pressure is terminated, it is necessary to "shut-in" the well until retrieval of some or all of the stored gas is needed.

To effect this well shut-in a normally closed safety valve is typically installed in the casing string and sealed therein using a packing structure. When it is desired to retrieve some of the pressurized gas stored in the cavern, the valve is simply opened to allow the pressurized gas to flow upwardly through the temporarily opened valve, into the wellhead structure through the casing string portion above the opened valve, and to a suitable receiving structure through an outlet pipe connected to the wellhead. To terminate upward flow of the stored gas, the safety valve is returned to its normally closed position.

Conventional safety valves, and their associated packer structures, used to shut-in gas storage wells in the manner generally described above are subject to several well known problems, limitations and disadvantages. For example, the opening of the casing-installed safety valve is typically effected using a vertical valve opening rod extending through the casing string, connected at its lower end to the movable valve closure element, and connected at its upper end to a pressure-actuated piston disposed in the wellhead structure and used to downwardly drive the rod to open the safety valve.

The use of this conventional piston/rod mechanical valve operating structure has two primary limitations. First, the movable valve element in the safety valve is typically spring-biased upwardly toward its normally closed position. When it is desired to permit this movable valve element to return to its normally closed position, its biasing spring must move not only the valve element upwardly, but the actuating rod member as well. Since the weight of the rod is directly proportional to its length, and the required size and force of the valve biasing spring are proportional to the weight of the rod, the maximum depth at which the safety valve may be installed in the casing string is often undesirably limited.

Additionally, the necessity of positioning the rod-driving piston structure renders this mechanical opening portion of the overall safety valve system susceptible to damage from vandalism and motor vehicles or other heavy equipment striking the wellhead structure.

Another limitation associated with safety valve systems of this general type is related to their related anchor and packer structures used to lock and seal them within the casing string to prevent stored gas from flowing upwardly through the casing string externally around the installed safety valve. This packer-related limitation comes in several varieties. For example, in one conventional type of shut-in application, the safety valve and its associated packer structure must be separately installed within the casing, using mechanical tools to set and later release the packer structure. In another type of valve and packer system, the packer portion of the shut-in system may be hydraulically set, but must be mechanically released using a suitable wireline tool.

In view of the foregoing it can be readily seen that it would be desirable to provide improved safety valve and packer apparatus, for use in shutting-in gas storage wells, which eliminates or at least substantially minimizes the above-mentioned problems, limitations and disadvantages associated with conventional valve and packer shut-in apparatus of the general type described. It is accordingly an object of the present invention to provide such improved safety valve and packer apparatus.

SUMMARY OF THE INVENTION

In carrying out principles of the present invention, in accordance with a preferred embodiment thereof, a specially designed combination packer/safety valve assembly is provided for use in shutting in a subterranean well, representatively a gas storage well, in which a casing string is extended through the earth to a source of pressurized well fluid.

The combination packer/safety valve assembly has a body portion lowerable into the casing string, representatively on the bottom end of tubing means such as a coil tubing string. The body portion has a normally closed first internal passage through which, when opened, pressurized well fluid may internally traverse the body portion, and a second internal passage for receiving a pressurized control fluid from a source thereof. Preferably, the pressurized control fluid is delivered to the second internal passage through the interior of the coil tubing string.

In the preferred embodiment of the assembly, first means are carried by the body portion and are operative to open the normally closed first internal passage during the presence of a predetermined first control fluid pressure within the second internal passage. Second means are also carried by the body portion and are operative to anchor and seal the body portion within the casing string in response to a predetermined second control fluid pressure created within the second internal passage and different than (representatively greater than) the predetermined first control fluid pressure. Third means are also carried by the body portion and are operative to release and unseal the body portion from the casing string in response to a predetermined third control fluid pressure created within the second internal passage and greater than either of the predetermined first and second control fluid pressures.

Accordingly, after lowering thereof to a predetermined location within the casing string the assembly can be (1) opened to permit pressurized well fluid flow therethrough and to the well surface via the casing string portion above the assembly, (2) set and sealed within the casing string, and (3) subsequently released and unsealed from the casing to permit the assembly to be pulled to the well surface on the coil tubing string using only pressurized control fluid delivered to the interior of the assembly.

This eliminates the previous necessity of using an above-surface piston structure to drive a mechanical valve actuating rod extending downwardly through the casing string, and also eliminates the necessity of using separate mechanical tools to set and/or release the safety valve from the interior of the casing string.

In an illustrated preferred embodiment of the assembly, a fluid pressure-driven main piston is used to forcibly engage a normally closed valve member interposed in the first internal passage. According to a feature of the invention, fluid pressure operable equalizing means are movably associated with the main piston and are operative, in response to control fluid pressure within the second internal passage, to reduce the opening force with which the main piston needs to forcibly engage the normally closed valve member. According to another feature of the invention, holding means are provided to releasably lock the second means in their anchoring and sealing relationship with the casing string once they are brought into anchoring and sealing engagement therewith.

DETAILED DESCRIPTION

Figure 1:
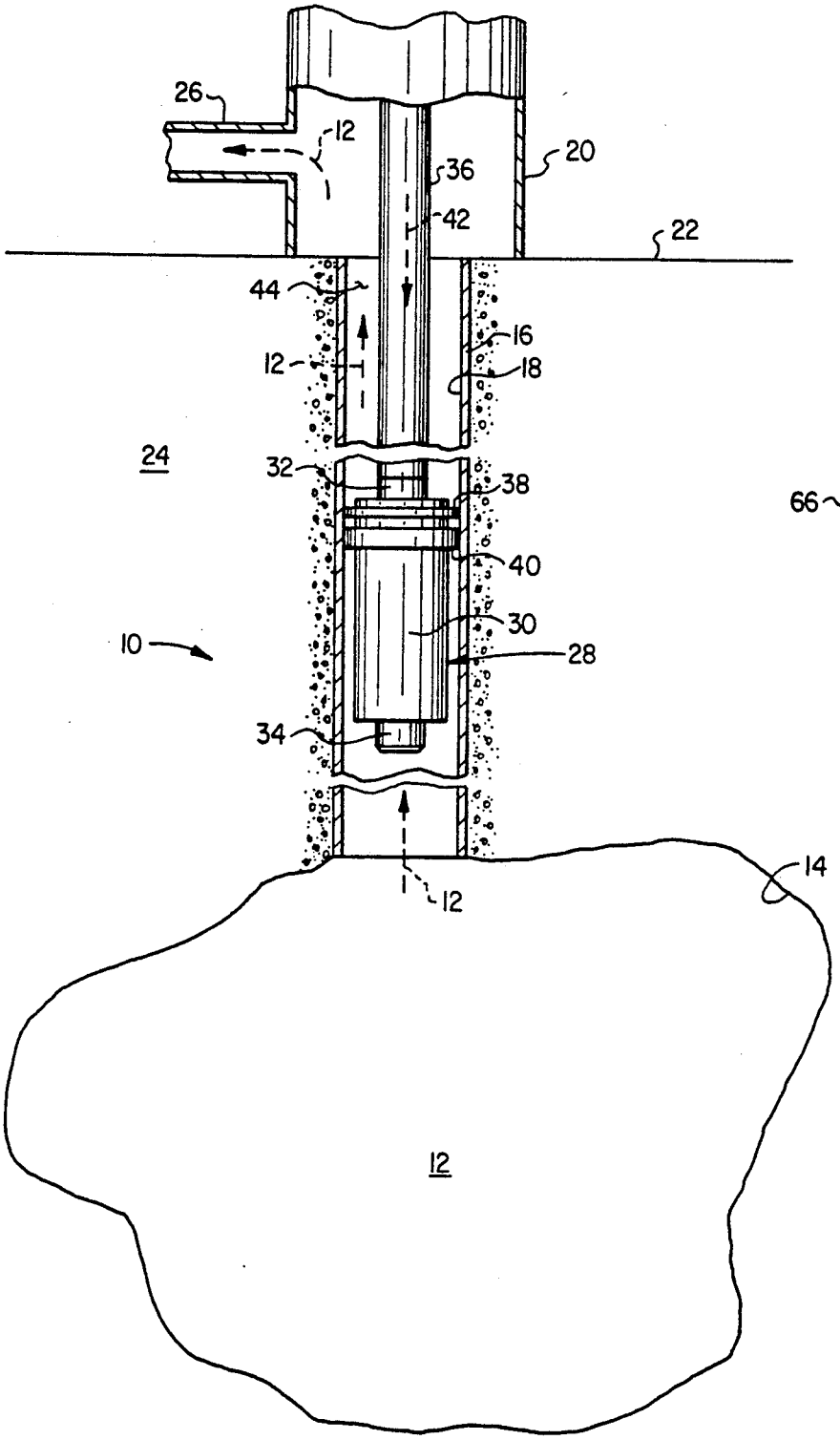
FIG. 1 is a highly schematic, vertically foreshortened cross-sectional view through a representative gas storage well having installed in a casing portion thereof a combination packer/safety valve assembly embodying principles of the present invention.

Schematically illustrated in FIG. 1 is a representative subterranean well in the form of a gas storage well 10 in which a pressurized supply of natural gas 12 is retained within a suitably pressure tight underground cavern 14 such as a salt cavern, an abandoned mine or the like. A casing string 16, having an interior surface 18, extends between a wellhead structure 20 disposed on the surface 22 of the earth 24 and the storage cavern 14 and is provided with an above ground gas delivery outlet pipe 26.

To control the flow of the stored, pressurized gas 12 upwardly through the casing string 16 and out the pipe 26 via the wellhead structure 20, the present invention provides a specially designed combination packer/safety valve assembly 28 having a hollow, generally cylindrical body portion 30 with upper and lower ends 32 and 34. As schematically illustrated, the body 30 has a maximum diameter somewhat less than that of the casing string interior surface 18.

The assembly 28 is connectable at its upper end 32 to the bottom end of tubing means, representatively in the form of coil tubing 36 extending vertically through the wellhead structure 20, and is lowerable therewith into the casing string 16 to a selected position above the gas storage cavern 14. Circumscribing the assembly body 30, adjacent its upper end, are a radially extendable slip anchor structure 38 and a radially extendable packer structure 40 disposed below the slip anchor structure. Additionally, normally closed valve means (not shown in FIG. 1) are operatively disposed in the lower end 34 of the body 30.

In a manner subsequently described herein, after the combination packer/safety valve 28 is lowered on the tubing string 36 (which is passed through a conventional lubricator structure) into the casing string 16 to a predetermined vertical position therein, with the slip and packer structures 38,40 in their radially retracted positions, a suitable control fluid 42 is forced downwardly through the tubing string 36 into the interior of the assembly body 30 and brought to a predetermined first control pressure. In response to this elevation of the pressure of the control fluid 42, the previously mentioned valve means in the lower body end portion 34 are opened to permit the indicated upward flow of stored gas 12 vertically through the interior of the assembly body 30, upwardly through the casing annulus 44 surrounding the tubing string 36, into the wellhead structure 20, and then outwardly through the gas delivery pipe 26.

The pressure of the control fluid 42 is then further elevated to a predetermined second control pressure. In response, the slip anchor and packer structures 38,40 are caused to radially expand against the interior surface 18 of the casing string 16 to anchor the assembly 30 within the casing string 16 and form an annular seal around the body 30 to prevent upward passage of the stored gas 12 externally around the body 30. As subsequently described, the assembly 28 is provided with holding means that automatically lock the slip and packer structures 38,40 in their extended positions in response to movement thereto from their initially retracted positions.

When it is desired to stop the upward delivery of stored gas 12 through the casing string 16 the control fluid pressure is simply reduced to a level below its valve-opening magnitude, thereby allowing the previously mentioned valve means to return to their normally closed position to terminate the upward flow of gas 12. If it becomes necessary to subsequently remove the assembly 28 from the casing string 16, the pressure of the control fluid 42 is simply elevated to a predetermined third magnitude greater the previously mentioned first and second magnitudes. In response, release means carried by the assembly body 30 move the slip and packer structures back to their initial retracted positions, thereby releasing and unsealing the assembly from the casing string and permitting it to be pulled upwardly through the casing string on the tubing string 36.

Structure of Combination Packer/Safety Valve Assembly 28

Figure 2:
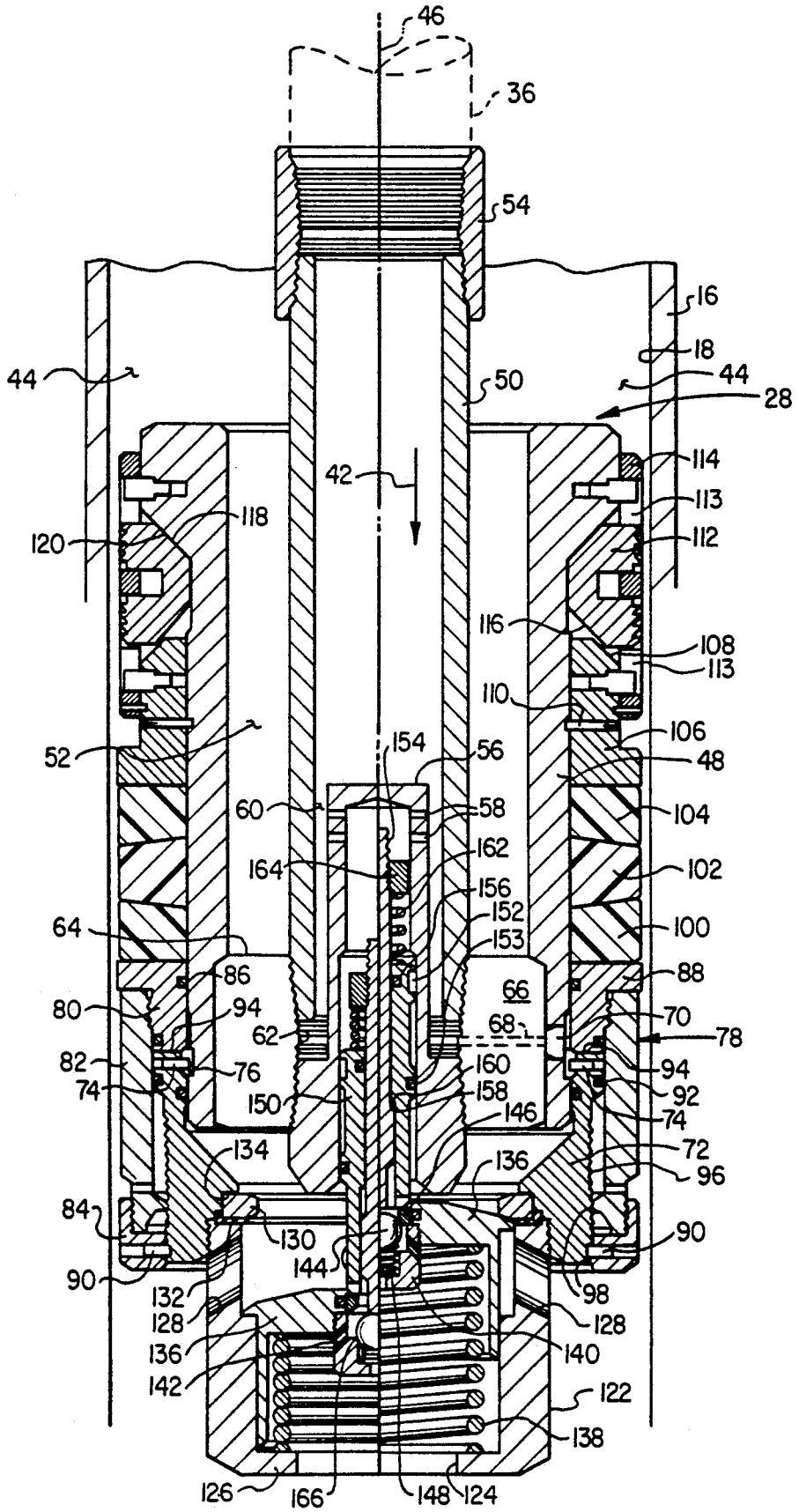
FIG. 2 is an enlarged scale cross-sectional view through the packer/safety valve assembly showing the assembly, on the right side of its vertical centerline, in its run-in position and, on the left side of its centerline, in its opened position, the horizontal scale of the assembly having been substantially enlarged for purposes of illustrative clarity.
Figure 3:
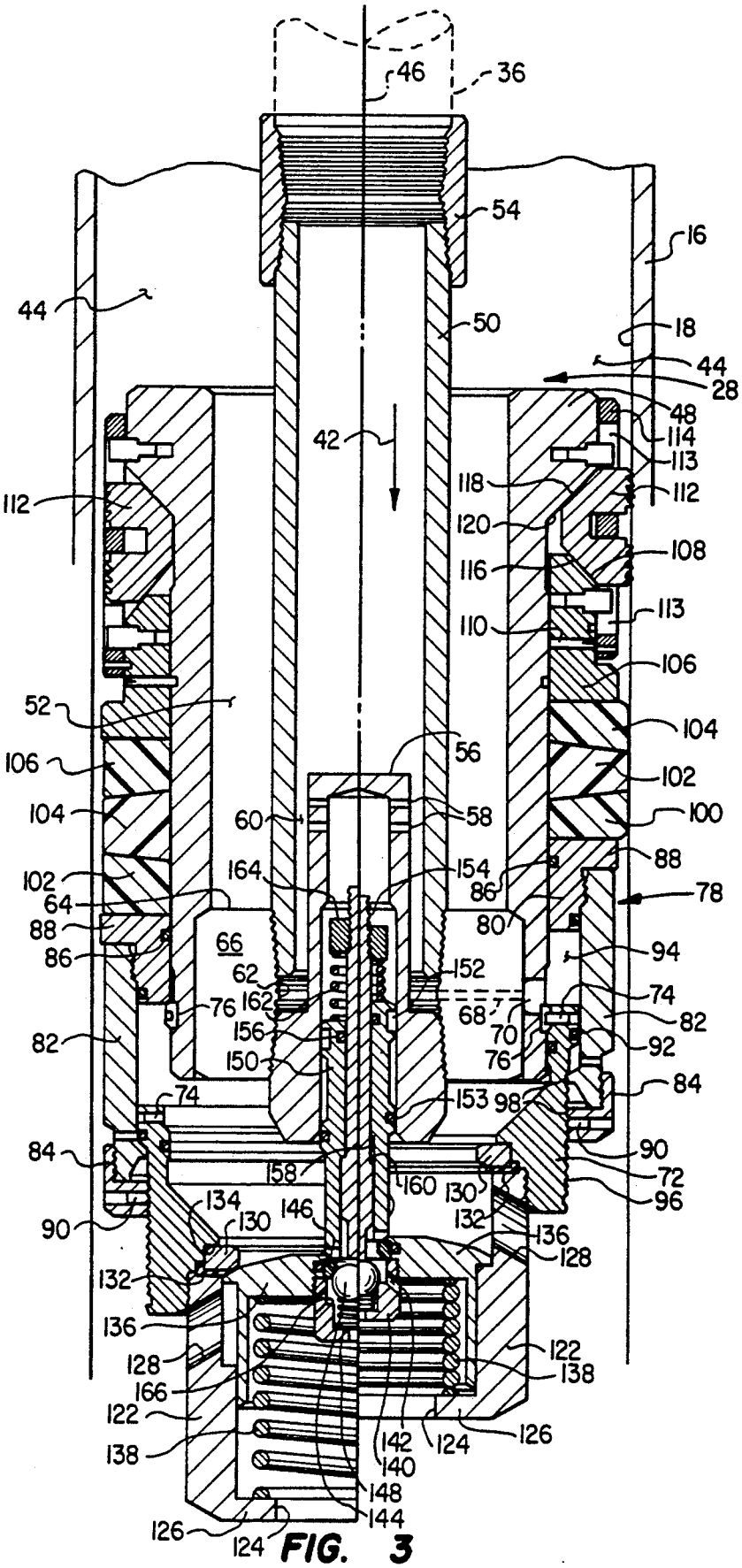
FIG. 3 is a cross-sectional view similar to that in FIG. 2, but with the assembly in its set position on the right side of its centerline, and in its released position on the left side of its centerline.

Referring now to FIGS. 2 and 3, the structure of the combination packer/safety valve assembly 28 will now be described in detail. FIGS. 2 and 3 are cross-sectional views of the assembly 28, in which the horizontal scale of the assembly 28 has been substantially enlarged relative to its vertical scale for purposes of illustrative clarity. For purposes of discussion and comparison, a vertical reference centerline 46 of the assembly has been shown. As will be subsequently described, the assembly components are shown in a "run-in" position thereof on the right side of the centerline 46 in FIG. 2; in a "valve opened" position on the left side of the centerline 46 in FIG. 2; in a "set" position on the right side of the centerline 46 in FIG. 3; and in a "release" position on the left side of the centerline 46 in FIG. 3.

The previously mentioned body portion 30 of the assembly 28 includes a hollow cylindrical outer packer mandrel 48 that coaxially receives a smaller diameter pup joint 50 which forms with the interior surface of the mandrel 48 a vertically extending annular stored gas flow passage 52 within the assembly 28. The upper end of the pup joint 50 is threaded into the lower end of a coupling 54 into the top end of which the bottom end of the tubing string 36 is threaded. An upper end portion of the pup joint 50 projects upwardly beyond the upper end of the packer mandrel 48 and forms the previously described upper end portion 32 of the assembly 28 (see FIG. 1).

Figure 4:
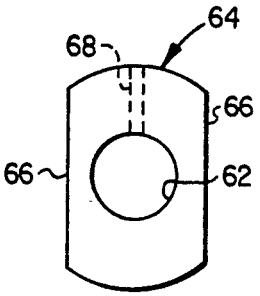
FIG. 4 is a reduced scale top side elevational view of an internal support and fluid transfer member portion of the combination packer/safety valve assembly.

A reduced diameter upper end portion of a hollow cylindrical debris trap member 56, having side inlet ports 58, extends upwardly into the lower end of the pup joint 50 and forms therewith an annular space 60. The lower end of the pup joint 50, and a radially enlarged lower end portion of the debris trap 56, are threaded into the central opening 62 an annular support and fluid transfer member 64 (see FIG. 4 also) having a diametrically opposite pair of flat areas 66 formed thereon and a radially extending flow passage 68 extending generally parallel to the flat areas 66. The member 64 is welded within an internally enlarged lower end portion of the mandrel 48, with a side wall flow port 70 of the mandrel 48 communicated with the outer end of the radial flow passage 68.

A lower end portion of the mandrel 48 is received within an interiorly enlarged upper end portion of an annular release collar 72. Release collar 72 is anchored to the lower end of the mandrel 48 by means of a circumferentially spaced series of shear pins 74 extending through the collar 72 into a snap ring 76 received in a corresponding annular groove formed in the outer side surface of the mandrel 48 downwardly adjacent the sidewall flow port 70 therein. As indicated, the snap ring 76 acts as an upward abutment for the collar 72 to prevent upward gas pressure forces imposed on the bottom end of the collar from being transmitted to the shear pins 74.

Outwardly circumscribing the collar 72 and a lower end portion of the mandrel 48 is an annular piston assembly 78 that includes an annular upper end cap 80, an annular body portion 82, and an annular lower end cap 84. The upper end cap 80 slidably engages the outer side surface of the mandrel 48, is dynamically sealed thereto by an O-ring 86, and has a radially outwardly projecting upper end flange 88. Below the flange 88 the upper end cap 80 is threaded into the upper end of the body portion 82, and a lower end portion of the body portion 82 is threaded into the lower end cap 84.

Lower end cap 84, and thus the piston structure 78, is anchored to the collar 72 by means of a circumferentially spaced series of shear pins 90 having shear strengths considerably less that the corresponding shear strengths of the shear pins 74. Body portion 82 is dynamically sealed to the collar 72 by an O-ring 92. For purposes later described, the upper end cap 80, the collar 72, and the body portion 82 bound a vertically expandable variable volume annular pressure chamber 94 that outwardly circumscribes the mandrel 48 and communicates with the mandrel sidewall flow port 70. Also for purposes later described, complementarily configured, intermeshing one-way ratchet threads 96,98 are respectively formed on the outer side of the collar 72 and on the inner side surfaces of the body portion 82 and the lower end cap 84. The intermeshed ratchet threads 96,98 permit the piston structure 78 to be moved upwardly along the mandrel 48, but prevent downward movement of the piston structure 78 relative to the mandrel 48.

The flange portion 80 of the upper end cap 80 upwardly engages the previously mentioned packer structure 40 (see FIG. 1) which is representatively defined by three vertically stacked resilient annular packer members 100,102,104 that coaxially circumscribe the mandrel 48. The uppermost packer member 104 engages the bottom end of an axially movable annular setting wedge member 106 that slidably circumscribes the mandrel 48 and has a tapered upper end surface 108. Shear pins 110 releasably anchor the wedge member 106 to the mandrel 48 to prevent inadvertent upward setting movement of the wedge member during run-in of the assembly 28 into the casing string.

Wedge member 106 forms a portion of the previously mentioned slip anchor structure 38 (see FIG. 1) which also includes a circumferentially spaced series of anchor slip members 112 carried in rectangular window portions 113 of an annular slip retainer member 114 circumscribing and fixedly secured to the mandrel 48. The slips 112 are radially movable between retracted and extended positions, with the tapered wedge surface 108 engaging correspondingly tapered bottom end surfaces of the slips 112, and tapered upper end surfaces 118 of the slips engaging an annular, correspondingly tapered surface 120 on an upper end portion of the mandrel 48.

At the lower end of the body of the assembly 28 is an annular spring housing 122 that is threaded into the open bottom end of the release collar 72. Housing 122 has a circular bottom end opening 124 bordered by an annular flange 126, and a circumferentially spaced series of inlet ports 128 are formed in the vertical side wall portion of the housing 122 adjacent its upper end. An annular metal valve seat 130 and an annular elastomeric seal element 132 carried on its bottom side surface are captively retained between the upper end of the housing 122 and an annular interior ledge portion 134 of the collar 72.

A normally closed annular, skirted valve member 136 is coaxially and slidably retained within the interior of the housing 122 and is upwardly biased into closed, sealing engagement with the annular resilient seal member 132 by a coil spring 138 bearing at one end against the top side of the flange 126 and at the other end against the underside of the valve member 136 as shown. A cup-shaped spring retaining member 140, having side wall inlet ports 142, is threaded into the top end opening of the valve member 136 and captively retains a seating ball 144. Ball 144 is upwardly biased into sealing engagement with an annular valve seat member 146, which is anchored within the top end opening of the valve member 136, by means of a coil spring member 148 captively retained within the spring retaining member 140.

A vertically elongated tubular main piston member 150 is coaxially disposed within the debris trap 56 and slidably carried therein by means of a non-sealing annular bushing member 152. A dynamic seal is formed between the main piston member 150 and the interior of the debris trap 56 by a resilient O-ring member 153 carried on the piston member, and the lower end of the piston member downwardly engages the annular valve seat 146 locked to the valve member 136.

For purposes later described, a vertically elongated cylindrical equalizing piston member 154 is slidably carried within the interior of the main piston member 150 and dynamically sealed therein by a resilient O-ring 156. The upward movement of the equalizing piston member 154 relative to the main piston member 150 is limited by the engagement of annular interior and exterior shoulders 158,160 respectively formed on the equalizing and main piston members 154 and 150, and the equalizing piston member 154 is biased toward this upper limit position by means of a coil spring member 162. Spring 162 is coaxially disposed within the debris trap 56, circumscribes an upper end portion of the equalizing piston 154, bears at its lower end against the upper end of the main piston 150, and bears at its upper end against an annular spring retaining member 164 threaded onto the upper end of the equalizing piston 154 and slidably received within the debris trap 56.

By moving the equalizing piston member 154 downwardly relative to the main piston member 150, against the upward biasing force of the spring 162, the lower end of the equalizing piston member 154 may be driven downwardly against the ball 144 to downwardly move it off its associated valve seat 146.

Operation of the Combination Packer/Safety Valve Assembly 28

When the combination packer/safety valve assembly 28 is initially lowered into the casing string 16 on the bottom end of the tubing string 3 to the predetermined position of the assembly 28 within the casing, the components of the assembly 28 are in their relative positions shown on the right side of the reference centerline 46 in FIG. 2. Specifically, the valve member 136 at the bottom end of the assembly is in its normally closed position, thereby precluding upward flow of the pressurized gas 12 upwardly through the interior of the assembly body; the ball 144 is in upward sealing engagement with its associated valve seat 146; and the packer elements 100,102,104 and the anchor slips 112 are in their radially retracted positions and spaced inwardly apart from the interior surface 18 of the casing string 16.

With the assembly 28 in its preselected vertical position within the casing string 16, the previously mentioned control fluid 42 is flowed down the vertical passage defined by the interiors of the tubing string 36 and the pup joint 50, and into the interior of the debris trap 56 via its side inlet ports 58. The pressure of the control fluid 42 is then increased to a predetermined first magnitude, representatively 500 psig, to cause the main piston 150 to be driven downwardly against the main valve member 136, against the upward biasing force of the spring 138, and move the valve 136 to its opened position shown on the left side of the reference centerline 46 in FIG. 2.

The opening of the valve member 136 permits the stored, pressurized gas 12 to sequentially flow inwardly through the spring housing inlet ports 128, upwardly through the annular assembly body interior flow passage 52 (past the flat areas 66 on the support and fluid transfer member 64), upwardly through the casing annulus 44, into the wellhead structure 20 (see FIG. 1), and then outwardly through the gas delivery pipe 26. This opening of the valve member 136, against the upward force of the spring 138 and the upward pressure force of the stored gas on the bottom of the valve member 136, is facilitated by the action of the equalizing piston 154 which is fluid pressure-driven downwardly relative to the main piston 150 to downwardly force the ball 14 off its associated seat 146.

The unseating of the ball 144 permits stored gas 12 to enter the spring retaining member ports 142, thereby downwardly and sealingly engaging the unseated ball 144 against an annular seating surface 166 formed within the interior of the spring retaining member 140. This entry of pressurized gas 12 into the member 140, and the downward shifting and seating of the ball 144, substantially reduces the net upward gas pressure force on the valve member 136 and facilitates its opening by the downward fluid-driven movement of the main piston 150.

Referring now to portion of the assembly 28 to the right side of the reference centerline 46 in FIG. 3, to anchor and seal the assembly 28 within the interior of the casing string 16, the pressure of the control fluid 42 is raised to a predetermined second magnitude, representatively 2000 psig. This further control fluid pressure rise forces control fluid radially outwardly through the flow passage 68 of member 64 and into the variable volume pressure chamber 94. The increase in fluid pressure in chamber 94 causes the pins 90 to shear, thereby vertically expanding the chamber 94, causing shearing of the pins 110, and driving the piston assembly 78 upwardly to its indicated set position in which it is locked by the action of the previously mentioned intermeshed ratchet teeth 96,98.

This upwardly driven movement of the external piston assembly 78 to its locked, set position correspondingly compresses the resilient packer members 100,102,104 between the upper end cap flange 88 and the setting wedge 106 which is driven upwardly relative to the mandrel 48. This fluid-driven component movement, in turn, radially outwardly deforms the packer elements 100,102,104 in to sealing engagement with the interior surface 18 of the casing string 16, and radially outwardly extends anchor slips 112 into biting, locking engagement with the interior surface 18 of the casing string 16, thereby locking and sealing the assembly 28 in place within the casing string.

After this setting process is completed, the control fluid pressure in the tubing string 36 may be lessened or eliminated to permit the valve member 136 to be automatically be returned to its normally closed position, and the seating ball 144 to also be returned to its normally closed position. Accordingly, the assembly 28 remains locked and sealed within the casing string 16, and precludes upward delivery of stored gas 12 through the casing string 16 until the fluid pressure within the tubing string 36 is again increased to at least 500 psig, the representative valve-opening pressure of the assembly 28.

Referring now to the portion of the assembly 28 to the left of the reference centerline 46 in FIG. 3, when it is subsequently desired to remove the assembly 28 from the casing string 16, all that is necessary is to temporarily increase the control fluid pressure in the tubing string 36 to a predetermined third magnitude, representatively 3500 psig, greater than the valve-opening and setting fluid pressures of the assembly. This further control fluid pressure increase causes the shear pins 74 to break and forces the piston assembly 78, the collar 72, and the spring housing 122 downwardly to their positions shown on the left side of FIG. 3. Such downward movement of these components relaxes the vertical compression force on the resilient packer members 100,102, and 104 and thus the upward force on the setting wedge 106. This, in turn, unseals and unlocks the assembly from the interior of the casing string as shown on the left side of FIG. 3 to permit the assembly to be simply lifted upwardly through the casing string 16.

It can be seen from the foregoing that the combination packer/safety valve assembly 28 of the present invention provides a variety of advantages over conventional packer and safety valve apparatus used to shut-in a gas storage well or other types of pressurized fluid wells. For example, all of the mechanical operating components of the assembly 28 are safely positioned below the well surface. There are no above-ground mechanical valve operating components, such as the usual piston and rod structure, which are susceptible to damage from, for example, vandalism or vehicular mishap. Moreover, no mechanical action and/or tools (such as wire line tools) are required to open the flow valve portion of the assembly, set the assembly within the casing, or subsequently release the assembly from the casing—all three of these functions are easily carried out simply by using control fluid pressure of different predetermined magnitudes.

While it is particularly convenient to use the interior of the tubing string 16 as a flow passage for operatively delivering the pressurized control fluid 42 into the interior of the body 30 of the assembly 28, it will be readily appreciated by those skilled in this particular art that other control fluid delivery means, such as a separate control fluid delivery line, could alternatively be utilized if desired.

Additionally, while the assembly 28 has been representatively illustrated and described herein as being used in conjunction with a gas storage well, it will also be readily appreciated that it could also be advantageously utilized as a shut-in device in a variety of other types of subterranean wells.

The foregoing detailed description is to be clearly understood as being given by way of illustration and example only, the spirit and scope of the present invention being limited solely by the appended claims.

What is claimed is:

1. A combination packer/safety valve assembly for use in controlling upward flow of a pressurized well fluid through a casing string portion of a subterranean well, comprising:

a body portion lowerable into the casing string and having:

a normally closed first internal passage through which, when opened, pressurized well fluid may internally traverse said body portion, and a second internal passage for receiving a pressurized control fluid from a source thereof;

first means carried by said body portion and operative to open said normally closed first passage during the presence of a predetermined first control fluid pressure within said second internal passage; and second means carried by said body portion and operative to anchor and seal said body portion within the casing string in response to a predetermined second control fluid pressure created within said second internal passage and different than said predetermined first control fluid pressure.

2. The assembly of claim 1 wherein:

said predetermined second control fluid pressure is greater than said predetermined first control fluid pressure.

3. The assembly of claim 2 further comprising:

third means carried by said body portion and operative to release and unseal said body portion from the casing string in response to a predetermined third control fluid pressure created within said second internal passage and greater than said predetermined second control fluid pressure.

4. The assembly of claim 1 wherein:

said first means include a main valve member interposed in said first internal passage, first biasing means for biasing said main valve member toward a closed position within said first internal passage, and main piston means pressure operable by control fluid in said second internal passage to engage and forcibly open said main valve member against well fluid pressure forces acting on said main valve member in opposition to movement thereof away from said closed position thereof, and said assembly further comprises equalizing means, operative in response to control fluid pressure in said second internal passage, for reducing the main piston means force required to be exerted on said main valve member to move it away from said closed position thereof.

5. The assembly of claim 4 wherein said equalizing means include:

an equalizing valve member interposed in said first internal passage, means for biasing said equalizing valve member toward a closed position thereof, and equalizing piston means carried by said main piston means for control pressure fluid-created driven movement relative thereto into engagement with said equalizing valve member in a manner driving it away from said closed position thereof.

6. A combination packer/safety valve assembly for use in controlling upward flow of a pressurized well fluid through a casing string portion of a subterranean well, comprising:

a body portion lowerable into the casing string and having a first internal passage through which pressurized well fluid may pass to the well surface via the casing string, and a second internal passage for receiving a pressurized control fluid;

normally closed valve means interposed in said first passage for releasably precluding the flow of pressurized well fluid through said first internal passage, said normally closed valve means being operative to be held open during the maintenance of a first predetermined control fluid pressure within said second passage; and anchor and seal means carried by said body portion, said anchor and seal means being operative to anchor and seal said body portion within the casing string in response to the creation of a predetermined second control fluid pressure within said second internal passage, said predetermined second control fluid pressure being different than said predetermined first control fluid pressure.

7. The assembly of claim 6 wherein:

said predetermined second control fluid pressure is greater than said predetermined first control fluid pressure.

8. The assembly of claim 7 wherein:

said anchor and seal means are further operative to release and unseal said body portion from the casing string in response to the creation of a predetermined third control fluid pressure within said second internal passage, said predetermined third control fluid pressure being greater than said predetermined second control fluid pressure.

9. The assembly of claim 6 further comprising:

equalizing means, responsive to control fluid pressure within said second internal pressure, for reducing the force required to open said normally closed valve means against a pressure force exerted thereon by the pressurized well fluid.

10. The assembly of claim 9 wherein:

said assembly further comprises main piston means for engaging and opening said valve means in response to the exertion of control fluid pressure on said main piston means, and equalizing means for reducing the main piston means force required to open said valve means against a pressure force exerted thereon by the pressurized well fluid, said equalizing means including:

an equalizing valve member interposed in said first internal passage, means for biasing said equalizing valve member toward a closed position thereof, and equalizing piston means carried by said main piston means for control pressure fluid-created driven movement relative thereto into engagement with said equalizing valve member in a manner driving it away from said closed position thereof.

11. A combination packer/safety valve assembly for use in controlling upward flow of a pressurized well fluid through a casing string portion of a subterranean well, comprising:

a body portion securable to the bottom end of a tubing string and lowerable therewith into the casing string;

first passage means, extending through said body portion, through which the pressurized well fluid may flow;

second passage means, extending through said body portion, for receiving a pressurized control fluid from a source thereof;

valve means interposed in said first passage means for movement therein between an open position in which said valve means permit fluid flow through said first passage means, and a closed position in which said valve means preclude fluid flow through said first passage means;

biasing means, carried by said body portion, for biasing said valve means toward said closed position thereof;

drive means for engaging said valve means and driving them to said open position thereof in response to the creation of a predetermined first control fluid pressure within said second passage means;

anchor and seal means carried by said body portion, said anchor and seal means being movable relative to said body portion between a retracted position in which said anchor and seal means said body portion to be moved axially through the casing string, and an extended position in which said anchor and seal means engage the interior surface of the casing string in a manner locking said body portion to the casing string and forming a fluid tight seal between said body portion and the casing string in a manner precluding flow of pressurized well fluid externally around said body portion;

shifting means for driving said anchor and seal means from said retracted position thereof to said extended position thereof in response to the creation of a predetermined second control fluid pressure within said second passage means, said predetermined second control fluid pressure being different than said predetermined first control fluid pressure; and holding means, responsive to movement of said anchor and seal means from said retracted position to said extended position by said shifting means, for locking said anchor and seal means in said extended position.

12. The assembly of claim 11 wherein:

said predetermined second control fluid pressure is greater than said predetermined first control fluid pressure.

13. The assembly of claim 12 further comprising:

release means for unlocking said anchor and seal means, and returning them from said extended position to said retracted position, in response to the creation of a predetermined third control fluid pressure within said second passage means, said predetermined third control fluid pressure being greater than said predetermined second control fluid pressure.

14. The assembly of claim 11 wherein:

said second passage means are positioned and configured to communicate with the interior of the tubing string and receive pressurized control fluid from the interior thereof.

15. The assembly of claim 11 wherein:

said biasing means include a spring.

16. The assembly of claim 11 wherein:

said drive means include main piston means carried within said body portion for control fluid pressure-driven movement into forcible opening engagement with said valve means, and said assembly further comprises equalizing means, responsive to control fluid pressure within said second passage means, for reducing the opening force required to be exerted on said valve means by said main piston means.

17. The assembly of claim 16 wherein said equalizing means include:

an equalizing valve member interposed in said first passage means, means for biasing said equalizing valve member toward a closed position thereof, and equalizing piston means carried by said main piston means for control pressure fluid-created driven movement relative thereto into engagement with said equalizing valve member in a manner driving it away from said closed position thereof.

18. The assembly of claim 11 wherein said shifting means include:

an external piston structure supported on said body portion and having a first section secured to said body portion by first frangible connection means having a first breaking strength, and a second section secured to said body portion by second frangible connection means having a second breaking strength greater than said first breaking strength, said first and second sections forming therebetween a variable volume pressure chamber positioned to receive pressurized control fluid from said second passage means and responsively create a force on said first and second sections urging them apart from one another and creating shear stresses in said first and second frangible connection means, said first section, in response to control fluid pressure breakage of said first frangible connection means, being pressure drivable away from said second section into forcible engagement with said anchor and seal means to drive them from said retracted position thereof to said extended position thereof.

19. The assembly of claim 18 further comprising:

release means for unlocking said anchor and seal means, and returning them from said extended position to said retracted position, in response to the creation of a predetermined third control fluid pressure within said second passage means, said predetermined third control fluid pressure being greater than said predetermined first and second control fluid pressures, said release means including said second section of said external structure, said second section being operative to break said second frangible connection means in response to creation of said predetermined control fluid pressure and be pressure driven away from said first section.

20. The assembly of claim 18 wherein said holding means include:

intermeshed ratchet threads formed on said body portion and said external piston structure.

* * * * *